US011339946B2

(12) United States Patent
Hong

(10) Patent No.: US 11,339,946 B2
(45) Date of Patent: May 24, 2022

(54) LAMP DEVICE FOR VEHICLE

(71) Applicants: Hyundai Motor Company, Seoul (KR); Kia Motors Corporation, Seoul (KR)

(72) Inventor: Seung-Pyo Hong, Incheon (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 0 days.

(21) Appl. No.: 17/203,168

(22) Filed: Mar. 16, 2021

(65) Prior Publication Data

US 2022/0090755 A1 Mar. 24, 2022

(30) Foreign Application Priority Data

Sep. 18, 2020 (KR) ..... 10-2020-0120604

(51) Int. Cl.

| | |
|---|---|
| ***F21S 45/46*** | (2018.01) |
| ***F28F 3/02*** | (2006.01) |
| ***F21S 45/47*** | (2018.01) |
| ***F28F 13/06*** | (2006.01) |

(52) U.S. Cl.

CPC ..... *F21S 45/46* (2018.01); *F21S 45/47* (2018.01); *F28F 3/02* (2013.01); *F28F 13/06* (2013.01)

(58) Field of Classification Search

CPC ..... F21S 45/30–46; F28F 3/02; F28F 3/12; F28F 13/06–16

See application file for complete search history.

(56) References Cited

FOREIGN PATENT DOCUMENTS

| | | | | |
|---|---|---|---|---|
| CN | 210771951 U | * | 6/2020 | |
| FR | 3085741 A1 | * | 3/2020 | ..... F21S 45/46 |
| JP | 2000-245014 A | | 9/2000 | |
| JP | 2020024790 A | * | 2/2020 | |

* cited by examiner

*Primary Examiner* — Mariceli Santiago

(74) *Attorney, Agent, or Firm* — Morgan, Lewis & Bockius LLP

(57) ABSTRACT

A lamp device applied to a vehicle may include a flow change generation device which accelerates an air flow in a space around a heat sink dissipating the heat due to the radiation of the light of a light source of an optical module to form the flow enhancing heat-dissipation efficiency of the heat sink, and generates the flow by the shake due to any one of an inertia force of a vehicle, a magnetic force, and a combination of the inertial force of the vehicle and the magnetic force, enhancing heat-dissipation efficiency by the heat dissipation using a change in the flow around a heat source together with the heat dissipation due to the heat sink.

19 Claims, 5 Drawing Sheets

LAMP DEVICE FOR VEHICLE

CROSS-REFERENCE TO RELATED APPLICATION

The present application claims priority to Korean Patent Application No. 10-2020-0120604, filed on Sep. 18, 2020, the entire contents of which is incorporated herein for all purposes by this reference.

BACKGROUND OF THE PRESENT INVENTION

Field of the Invention

The present invention relates to a lamp for a vehicle, and particularly, to a lamp device for a vehicle, which utilizes the inertia and engine tremors by a vehicle traveling as vibrations, thereby largely enhancing heat-dissipation efficiency by a change in the flow around a heat source.

Description of Related Art

A lamp for a vehicle generates heat by the light emission of a light emitting diode (LED) or a bulb and thus needs heat dissipation for protecting component elements inside the lamp from the heat.

For the heat dissipation of the lamp, a natural convection method for introducing an outside air flow into an internal space of the lamp or a forced circulation method for introducing the outside air into the internal space of the lamp by a fan is applied, but a lamp heat-dissipation structure using a heat sink is more widely applied to enhance heat-dissipation efficiency.

As an example, the heat sink lamp heat-dissipation structure is a scheme which has a body forming an air flow path and a plurality of pins expanding radially as basic components, maximizing the heat transfer of the natural convection per a unit area.

Therefore, the heat sink lamp heat-dissipation structure may enhance heat-dissipation efficiency for the LED lamp for a vehicle having a high heat density.

However, in recent years, an LED lamp widely applied has an increased heat density due to an increase in the number of LEDs in an LED module for illumination such that it is very difficult to obtain effective heat-dissipation efficiency necessary for maintaining the reliability and performance for the LED only with the heat sink.

The information included in this Background of the Invention section is only for enhancement of understanding of the general background of the invention and may not be taken as an acknowledgement or any form of suggestion that this information forms the prior art already known to a person skilled in the art.

BRIEF SUMMARY

Various aspects of the present invention are directed to providing a lamp device for a vehicle, which may largely enhance the heat-dissipation efficiency with the heat dissipation using a change in the flow around a heat source together with the heat dissipation by the heat sink, and utilize the inertia by a change in a vehicle traveling state and the vibration of engine tremors or a magnetic force or a combination of the vibration/the magnetic force, implementing the heat-dissipation of the heat source and a heat sink only by a change in the flow around the heat source without an electronic device.

A lamp device for a vehicle according to various exemplary embodiments of the present invention for achieving the object includes: an optical module having a light source of radiating light; a heat sink for dissipating a heat caused by the light source by an air flow; and a flow change generation device configured for generating a flowage of a fluid by a flowage movement of the fluid due to any one of an inertia force of a vehicle due to the deceleration or acceleration of a vehicle, a magnetic force due to the supply of power, and a combination of the inertia force of the vehicle and the magnetic force, and dispersing the heat into the air flow, enhancing heat-dissipation efficiency of the heat sink.

As various exemplary embodiments of the present invention, the flow change generation device includes a vibration box having a first fluid including any one of air, benzene, and toluene and a second fluid made of mercury or water having different densities filled in the vibration box, and the first fluid and the second fluid form the flowage of a fluid in the vibration box due to the inertia force of the vehicle to cause flowage movement of the fluid in the vibration box.

As the exemplary embodiment of the present invention, the first fluid is made of a rarer material, and the second fluid is made of a denser material to form a density difference between the first fluid and the second fluid.

As the exemplary embodiment of the present invention, the flow change generation device includes a vibration box having the fluid which is water ($H_2O$) filled therein and having a solid, which is a metal, accommodated therein, and the fluid converts the movement of the solid due to the inertia force of the vehicle to the flowage of the fluid to cause a flowage movement of the fluid in the vibration box.

As the exemplary embodiment of the present invention, the flow change generation device includes a vibration box having a first fluid and a second fluid having different densities and filled in the vibration box, and the electromagnet for generating the magnetic force, and a first flowage of the fluid of the first fluid and the second fluid caused by the inertia force of the vehicle and a second flowage of the fluid due to the magnetic force of the electromagnet are applied to the vibration box in combination to cause the shake.

As the exemplary embodiment of the present invention, the first fluid is made of a rarer material which is any one of a polar material and a non-polar material, and the second fluid is made of a denser material which is any one of a polar material and a non-polar material.

As the exemplary embodiment of the present invention, the electromagnet is mounted on any one of one side location outside the vibration box or one side location and the lower side location of the vibration box, one side location inside the vibration box, the other side location inside the vibration box, and one side location inside the vibration box while applying the power source to the light source of the optical module.

As the exemplary embodiment of the present invention, the flow change generation device includes a vibration box having a first fluid made of a rarer material, which is any one of a polar material and a non-polar material, and a second fluid made of a denser material, which is any one of the polar material and the non-polar material, filled therein, and an electromagnet provided on any one of one side location outside the vibration box, one side location and the lower side outside the vibration box, one side location inside the vibration box, and the other side location inside the vibration box.

As the exemplary embodiment of the present invention, the electromagnet is connected to a current controller, and the current controller is configured to supply a current to the electromagnet such that the magnetic force is generated or blocks a supply of the current to the electromagnet such that the magnetic force is released.

As the exemplary embodiment of the present invention, the optical module applies any one of a bulb, an LED, and an LAM as the light source.

Furthermore, a vehicle according to various exemplary embodiments of the present invention for achieving the object includes: a lamp device having a flow change generation device which accelerates an air flow in a space around a heat sink dissipating the heat due to the radiation of the light of a light source of an optical module to form the flow enhancing heat-dissipation efficiency of the heat sink, and generates a flowage of a fluid by a flowage movement of the fluid due to any one of an inertia force of a vehicle, a magnetic force, and a combination of the inertial force of the vehicle and the magnetic force.

As various exemplary embodiments of the present invention, the inertia force of the vehicle is generated by the deceleration or acceleration of the vehicle, and the magnetic force is generated by the supply of power to an electromagnet.

The lamp device for a vehicle according to various exemplary embodiments of the present invention implements the following operations and effects.

First, the heat dissipation by the heat sink and the heat dissipation by the change in the air flow may produce the synergy effect, largely enhancing the heat-dissipation efficiency around the heat source of the lamp. Second, the motion of the flow change generation device configured for generating the change in the air flow around the heat source may be caused by the inertia of the vehicle traveling and the vibration using the engine tremors or caused by the magnetic force or a combination of the vibration and the magnetic force, improving the lamp heat-dissipation effect without the electronic device configured for the light source, the PCB, and the heat sink. Third, the volume heat resistance may be reduced by generating a flowage of a fluid due to the change in the air flow, reducing the required heat-dissipation volume to about ⅓ compared to when the change in the air flow is not applied. Fourth, it is possible to reduce the heat resistance of the heat sink by the heat dissipation due to the change in the air flow in the state of increasing the heat-dissipation effect of the heat sink to effectively reduce the LED temperature, increasing the light amount of the LED and increasing the life span, and to discharge less the haze owned by the polymer material or the gaseous object such as vapor, improving the quality of the lamp. Fifth, it is possible to reduce the size and weight of the heat sink as much as the heat-dissipation effect due to the change in the air flow, improving fuel efficiency due to the decrease in the vehicle tolerance weight, further facilitating the assembling work of the worker due to the decrease in the weight of the single lamp, and reducing the cost and weight due to the decrease in the required weight of the heat sink.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
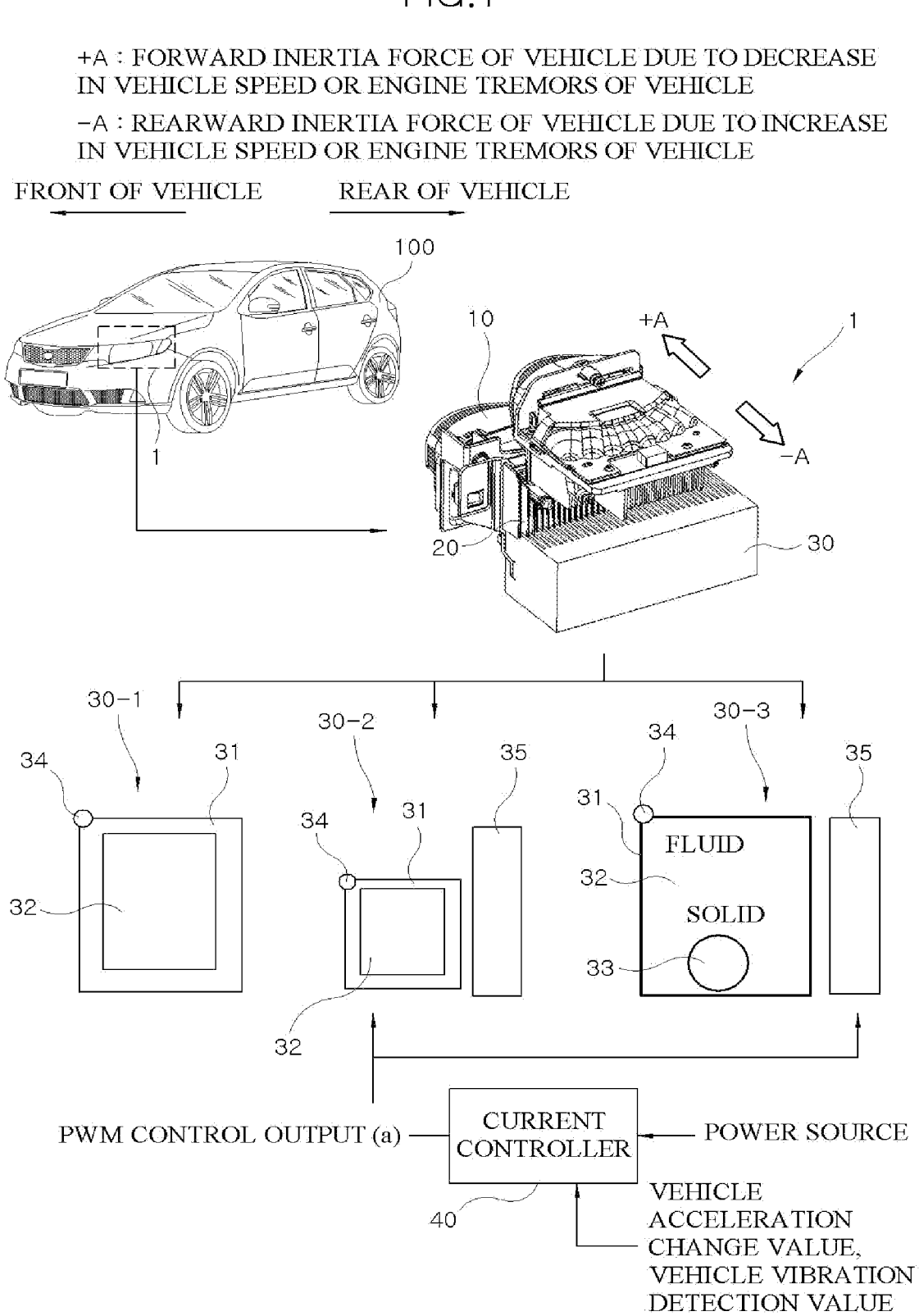
FIG. 1 illustrates an example in which a lamp device configured for a vehicle according to various exemplary embodiments of the present invention includes any one of a vibration-type flow change generation device, an electromagnet-type flow change generation device, and a hybrid-type flow change generation device.

It may be understood that the appended drawings are not necessarily to scale, presenting a somewhat simplified representation of various features illustrative of the basic principles of the present invention. The specific design features of the present invention as included herein, including, for example, specific dimensions, orientations, locations, and shapes will be determined in part by the particularly intended application and use environment.

In the figures, reference numbers refer to the same or equivalent portions of the present invention throughout the several figures of the drawing.

DETAILED DESCRIPTION

Reference will now be made in detail to various embodiments of the present invention(s), examples of which are illustrated in the accompanying drawings and described below. While the present invention(s) will be described in conjunction with exemplary embodiments of the present invention, it will be understood that the present description is not intended to limit the present invention(s) to those exemplary embodiments. On the other hand, the present invention(s) is/are intended to cover not only the exemplary embodiments of the present invention, but also various alternatives, modifications, equivalents and other embodiments, which may be included within the spirit and scope of the present invention as defined by the appended claims.

Hereinafter, an exemplary various exemplary embodiments of the present invention will be described in detail with reference to the accompanying drawings, and the exemplary embodiment of the present invention may be implemented in various different forms by those skilled in the art to which various exemplary embodiments of the present invention pertains as an example and thus is not limited to the exemplary embodiment described herein.

Referring to FIG. 1, a lamp device 1 applied to a vehicle 100 includes an optical module 10, a heat sink 20, and a flow change generation device 30. In the instant case, as the lamp device 1, the head lamp is referred to as an example but the lamp device 1 may be any one of a daytime running lights, a fog lamp, a turn signal lamp, a side repeater, an emergency light, a brake lamp, a back-up lamp, and a tail lamp.

The optical module 10 includes a light source for emitting light by the supply of the power to radiate the light, a substrate having the light source and for supplying the power source, and an optical system for causing the light radiated from the light source to be directed to the desired direction thereof.

The light source is any one of a bulb, a light emitting diode (LED), and an LED assay module (LAM). The substrate is a printed circuit board (PCB) forming an electric circuit and a signal processing circuit to which components of several elements are connected, and a power source circuit. The optical system adjusts the light radiation direction of the light source through an aiming device, and the aiming device is a component of the general lamp device 1 operated by an actuator or a motor driven by an electric signal of a switch.

The heat sink 20 has a plurality of heat-dissipation pins, and disperses the heat of the light source by the air flow formed in a space around the optical module 10, enhancing the heat-dissipation effect.

The flow change generation device 30 causes the change in the air flow in the space around the optical module 10 and the heat sink 20 by the inertia by the vehicle traveling, the vibration using the engine tremors, the magnetic force, and a combination of the vibration and the magnetic force, rapidly reducing the temperature around the heat source, and strengthens the air flow for the heat sink 20, largely enhancing the heat-dissipation efficiency of the heat sink. In the instant case, the inertia may be classified into the decrease in the vehicle speed of a vehicle (i.e., braking situation) or the forward inertia force of the vehicle (+A) due to the engine tremors and the increase in the vehicle speed of the vehicle (i.e., acceleration situation) or the rearward inertia force of the vehicle (−A) due to the engine tremors.

To the present end, the flow change generation device 30 includes any one of a vibration-type flow change generation device 30-1, an electromagnet-type flow change generation device 30-2, and the hybrid-type flow change generation device 30-3.

As an example, the vibration-type flow change generation device 30-1 includes a vibration box 31, a fluid 32, and a hinge shaft 34. The vibration box 31 is formed of a sealed structure in which the fluid 32 is filled in the internal space. A flowage of the fluid 32 occurs in the internal space of the vibration box 31 by the inertia and the vibration using the engine tremors. The hinge shaft 34 is coupled to one side edge portion of the vibration box 31 such that the vibration box 31 may be moved by the flowage of the fluid 32, and operates as the rotating center such that the motion of the vibration box 31 causes a vibration angular motion K (see FIG. 4).

The vibration box 31 may be hinged to a housing of the optical module 10 via the hinge shaft 34 to be located around the heat sink 20 or hinged to the heat sink 20 to be configured together with the heat sink 20.

Furthermore, the fluid 32 is made of a rarer material and a denser material, and the rarer material and the denser material have different density differences like first and second fluids 32A, 32B (see FIG. 2), enhancing the flowage movement of the fluid. Furthermore, the hinge shaft 34 may be integrated with a box housing on one side edge portion of the vibration box 31 by the pin structure or screw-coupled to the box housing on one side edge portion of the vibration box 31 by the bolt shaft structure.

As described above, the vibration-type flow change generation device 30-1 causes the flowage movement of the fluid due to the density difference between the materials of the fluid 32 within the vibration box 31 by the inertia force (i.e., +A inertia force or −A inertia force) transferred by the change in the vehicle speed or the vibration due to the engine tremors, and causes the air flow around the heat source by the caused flowage movement of the fluid, and the air flow causes the flow rate in the air around the heat source.

As an example, the electromagnet-type flow change generation device 30-2 includes the vibration box 31, the fluid 32, the hinge shaft 34, and an electromagnet 35. In the instant case, each of the vibration box 31, the fluid 32, and the hinge shaft 34 has the same structure, operation, and effect as that of the vibration-type flow change generation device 30-1.

Therefore, the electromagnet-type flow change generation device 30-2 may be understood as a configuration in which the electromagnet 35 is added to the vibration-type flow change generation device 30-1.

However, the fluid 32 configures the rarer material and the denser material as a polar material and non-polar material such that the polar material causes the change in a flowage of the fluid by the electromagnet 35. Furthermore, the electromagnet 35 generates the magnetic force by generating the electromagnetic induction due to the current flow when a current is supplied to cause the flowage movement of the fluid 32 within the vibration box 31.

To the present end, the electromagnet 35 is formed in a coil shape, and the coil shape makes one strand of coil consecutively long in a row into a rectangular frame to be coupled to surround the PCB substrate, and the power source is connected to the bending portions of both side ends of the strand of the coil as a (−) pole terminal and a (+) pole terminal to generate the electromagnetic induction by the current flowing through the coil shape, forming the direction of the magnetic force in the direction of mounting the element of the PCB substrate (e.g., surface direction).

As an example, the magnetic force of the electromagnet 35 may generate the repetitive movement in the fluid 32 by alternately performing an operation of generating the magnetic force when the electromagnet is ON (i.e., current is supplied) whereas releasing the generation of the magnetic force when the electromagnet is OFF (i.e., the supply of current is stopped), and may generate stronger repetitive movement in the fluid 32 by controlling the supply current by the pulse width modulation (PWM) to be accompanied by magnetic fluctuation.

Further, the electromagnet-type flow change generation device 30-2 further includes a current controller 40 and the current controller 40 controls a supply of the current to the electromagnet 35 by the ON/OFF of the electromagnet, and controls the supplied current by the pulse width modulation (PWM). To the present end, the current controller 40 processes a vehicle acceleration change value of an acceleration sensor for detecting the deceleration and acceleration of the vehicle and/or a vehicle vibration detection value of a vibration sensor for detecting the vibration of the vehicle as input information, and performs the ON/OFF of the electromagnet and the PWM control based on the vehicle acceleration change value and/or the vehicle vibration detection value.

As described above, in the electromagnet-type flow change generation device 30-2, the magnetic force generated by supplying the current to the electromagnet 35 occurs a flowage of the fluid 32 such that the flowage of the fluid 32 further adds the flowage of the magnetic force to the flowage of the inertia using the inertia force (i.e., +A inertia force or −A inertia force) due to the change in the vehicle speed, and a combination of the flow of the inertia and the flow of the magnetic force further increases the flowage movement of the fluid such that the movement of the vibration box 31 via the hinge shaft 34 generates the vibration angular motion K (see FIG. 5), strengthening the air flow around the heat source to generate a faster air flow rate in the air around the heat source.

As an example, the hybrid-type flow change generation device 30-3 includes the vibration box 31, the fluid 32, a solid 33, the hinge shaft 34, and the electromagnet 35. In the instant case, each of the vibration box 31, the fluid 32, the hinge shaft 34, and the electromagnet 35 has the same structure, operation, and effect as that of the electromagnet-type flow change generation device 30-2.

Therefore, the hybrid-type flow change generation device 30-3 may be understood as a configuration of further adding the solid 33 to the electromagnet-type flow change generation device 30-2. Furthermore, the hybrid-type flow change generation device 30-3 may be understood as a configuration of further adding the solid 33 and the electromagnet 35 to the vibration-type flow change generation device 30-1.

However, the fluid 32 is made of the rarer material having polarity whereas the solid 33 applies the denser material and polar material of a metallic material such that both the fluid 32 and the solid 33 may be moved by the magnetic force of the electromagnet 35 with polarity, and the change in the flowage of the fluid 32 within the vibration box 31 may be caused by a combination of the fluid 32 and the solid 33 more strongly, further strengthening the flowage of the fluid 32 within the vibration box 31.

As described above, in the hybrid-type flow change generation device 30-3, the magnetic force generated by supplying the current to the electromagnet 35 occurs a flowage of the fluid 32 and the solid 33 such that the fluid 32 and the solid 33 further add the flowage of the magnetic force to the flowage of the inertia using the inertia force (i.e., +A inertia force or −A inertia force) due to the change in the vehicle speed, and a combination of the flowage of the inertia of the fluid 32 and the solid 33 and the flowage of the magnetic force of the fluid 32 and the solid 33 further increases the flowage movement of the fluid, further strengthening the air flow around the heat source to generate a faster air flow rate in the air around the heat source.

Figure 2:
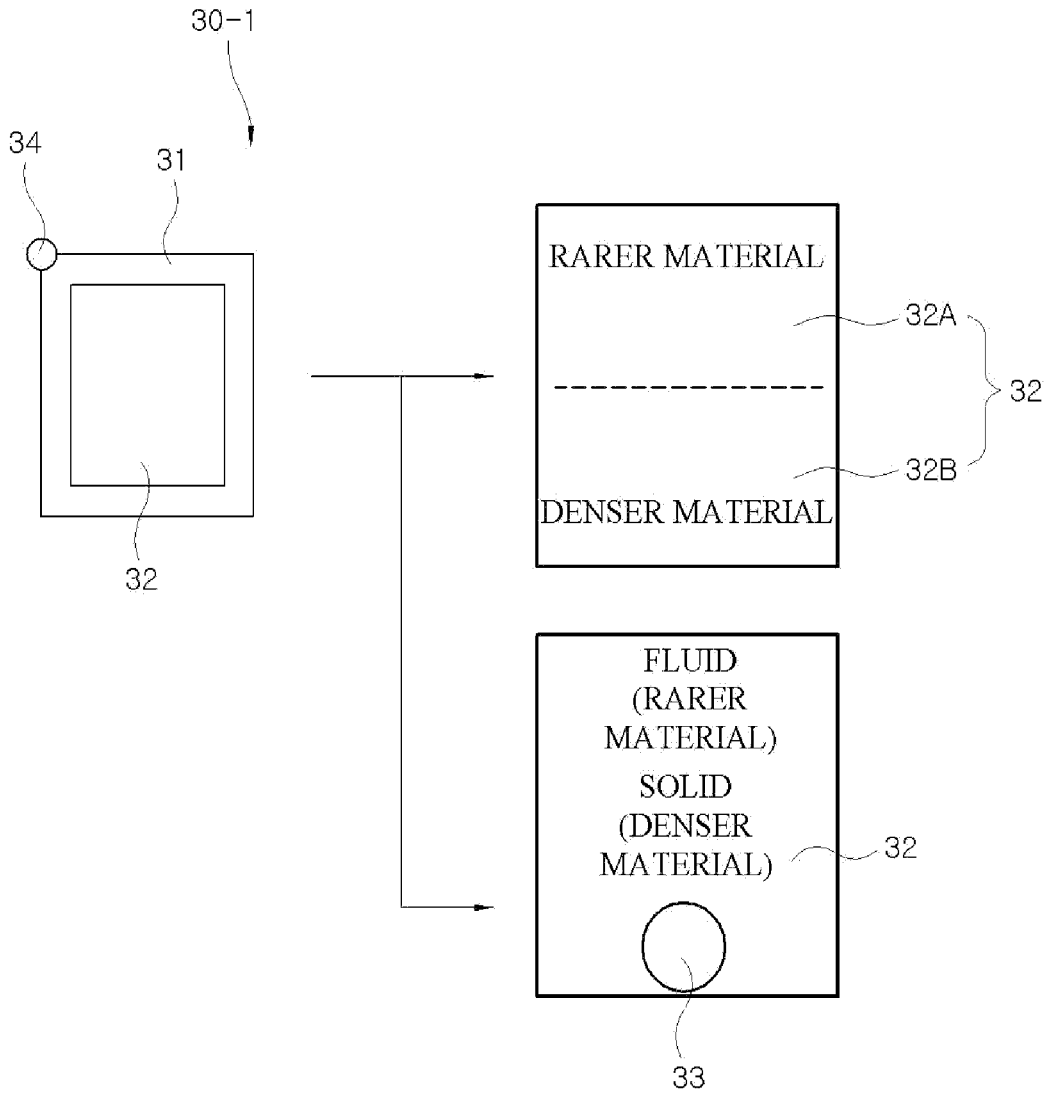
FIG. 2 illustrates an example of a configuration of the vibration-type flow change generation device according to various exemplary embodiments of the present invention.

Meanwhile, FIG. 2 illustrates an example of various configurations of the vibration-type flow change generation device 30-1.

As illustrated, in the vibration-type flow change generation device 30-1, the material filled inside the vibration box 31 is configured by a combination of at least one of the fluid 32, the first fluid 32A, the second fluid 32B, and the solid 33. In the instant case, the fluid 32, the first fluid 32A, the second fluid 32B, and the solid 33 are materials having non-polarity.

As an example, the vibration box 31 is filled with the first fluid 32A and the second fluid 32B having different materials (i.e., rarer material and denser material) such that the fluid is moved by the density difference between the first fluid 32A and the second fluid 32B.

As various exemplary embodiments of the present invention, the vibration box 31 is filled with the fluid 32 and the solid 33 having different materials (i.e., rarer material and denser material) such that the fluid is moved together by the movement of the solid 33 together with the flowage movement of the fluid due to the density difference between the fluid 32 and the solid 33.

As described above, the vibration-type flow change generation device 30-1 utilizes the first and second fluids 32A, 32B or the fluid 32/the solid 33 having the density difference as the different materials filled inside the vibration box 31 such that the flowage movement of the fluid of the first and second fluids 32A, 32B or a stronger flowage movement of the fluid of the fluid 32/the solid 33 is caused by the flowage of the inertia using the inertia force (i.e., +A inertia force or −A inertia force) due to the change in the vehicle speed, and the caused movement moves the vibration box 31 to cause the air flow rate in the neighboring air around the heat source (i.e., the light source 10).

The different materials may be applied as below.

[Below]

① air (rarer material 32A)+water (denser material 32B)

② water (fluid 32)+metal (solid 33)

③ air (rarer material 32A)+benzene (polar material)+water (denser material 32B)

Therefore, the reflectance of the light source is increased compared to the rarer material by use of the metal (or mercury), which is the denser material and has polarity such that the light source may be reflected or totally reflected on a beam pattern forming surface of a beam pattern forming portion of the optical module 10 due to the difference of the refractive index/the reflectance.

As in the case of the "③ air (rarer material 32A)+benzene (intermediate material)+water (denser material 32B)", when the fluid 32 is applied with three or more types of different materials, the fluid, such as benzene, toluene, CC14, or mercury, as the polar material may make the refractive index having a larger difference compared to the rarer material.

Figure 3:
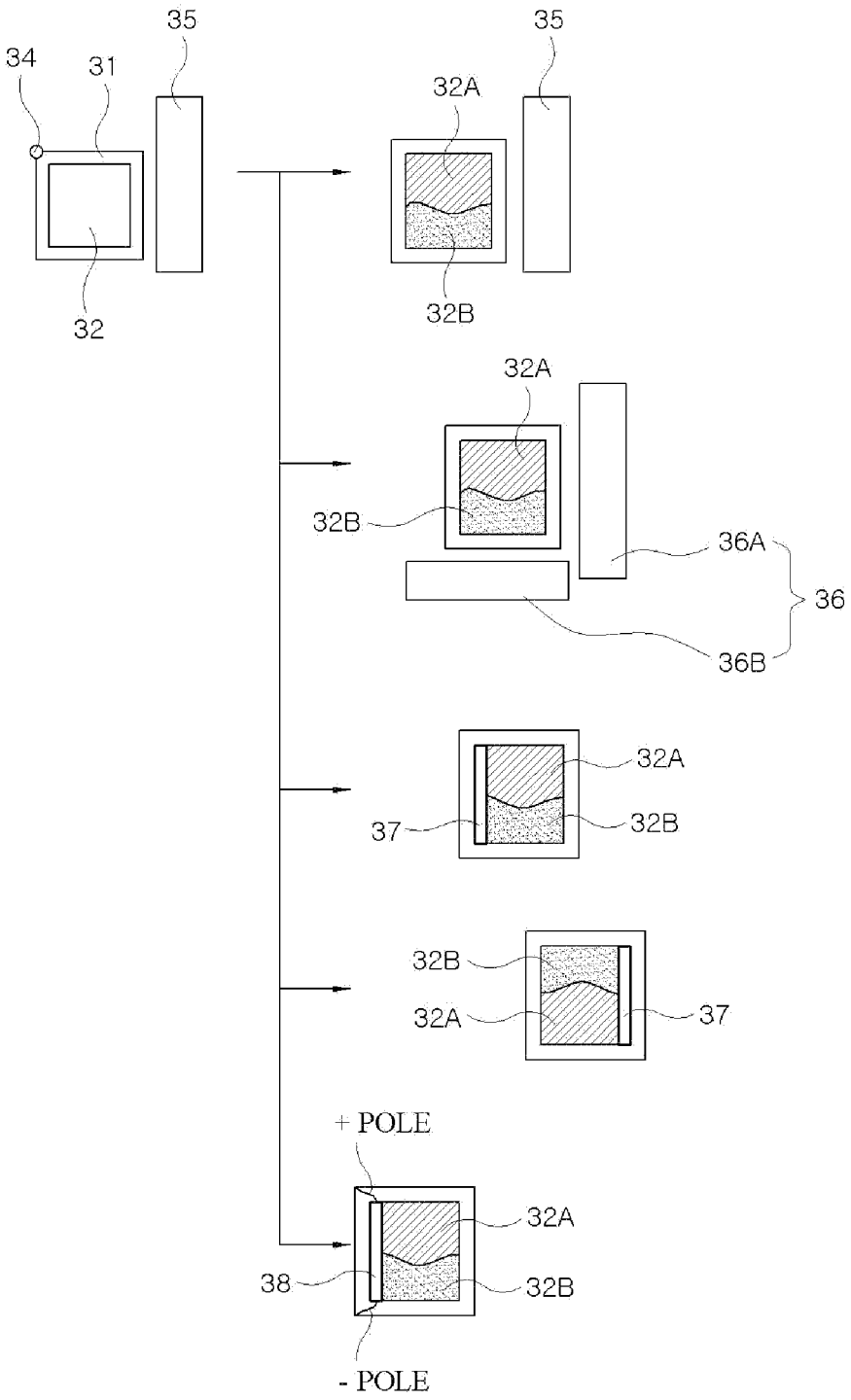
FIG. 3 illustrates an example of a configuration of the electromagnet-type flow change generation device according to various exemplary embodiments of the present invention.

On the other hand, FIG. 3 illustrates an example of various configurations of the electromagnet-type flow change generation device 30-2.

As illustrated, the electromagnet-type flow change generation device 30-2 is configured by combining at least one of the vibration box 31, the first and second fluids 32A, 32B having the density difference, the electromagnet 35, a dual electromagnet 36, an embedded electromagnet 37, and a PCB electromagnet 38. In the instant case, the first fluid 32A and the second fluid 32B are materials having polarity.

As an example, the vibration box 31 is filled with the first and second fluids 32A, 32B having the density difference such that the flowage of the inertia using the inertia force (i.e., +A inertia force or −A inertia force) due to the change in the vehicle speed is basically caused by the flowage movement of the fluid.

Furthermore, the vibration box 31 has one electromagnet 35 on one side thereof outside the box, has the dual electromagnet 36 including one second electromagnet 36B disposed on the lower side thereof together with one first electromagnet 36A disposed on one side thereof, has one embedded electromagnet 37 on one side thereof or the other side thereof inside the box, or has one PCB electromagnet 38 on one side inside the box.

Each of the electromagnet 35, the first and second electromagnets 36A, 36B, and the embedded electromagnet 37 is the same as the electromagnet formed in the coil shape having the (−) pole/(+) pole terminals illustrated in FIG. 1. However, each of the electromagnet 35 and the first and second electromagnets 36A, 36B is not directly in contact with the first and second fluids 32A, 32B but the embedded electromagnet 37 is directly in contact with the first and second fluids 32A, 32B and thus may apply a waterproof structure, and in the instant case, a material applied to the waterproof structure allows the magnetic force to transmit therethrough.

On the other hand, the PCB electromagnet 38 applies the structure formed in the coil shape having the (−) pole/(+) pole terminals illustrated in FIG. 1, but is formed of an LED assay module (LAM) PCB integrated structure which applies power to an electromagnet or an induction coil by utilizing the (−) pole/(+) pole power source terminals located on the PCB for applying the power to the light source of the optical module 10. In the instant case, the (−)

pole/(+) pole power source terminals of the PCB are drawn out to the outside of the vibration box 31.

Figure 4:
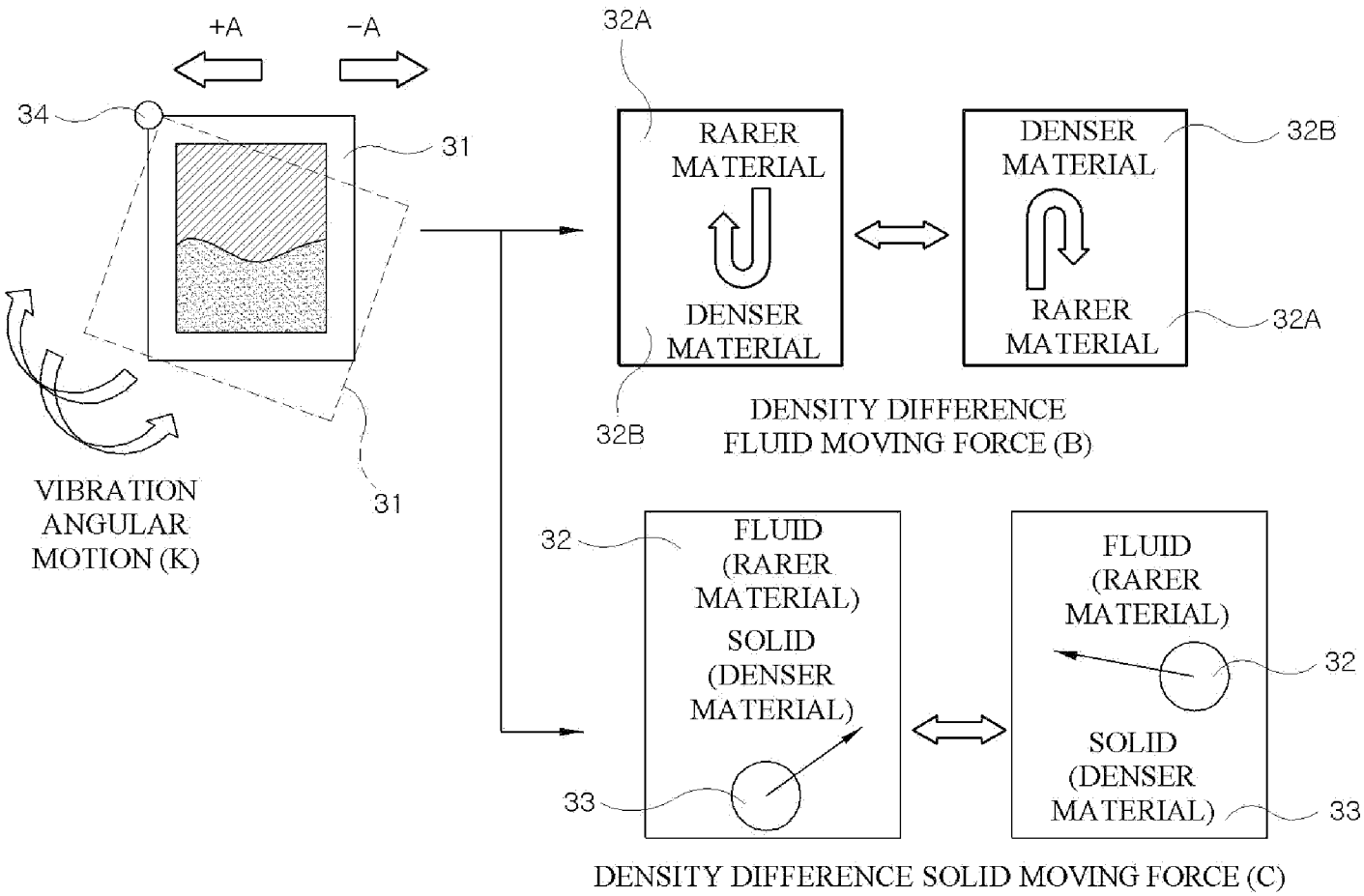
FIG. 4 illustrates an example of an operation state of the vibration-type flow change generation device according to various exemplary embodiments of the present invention.
Figure 5:
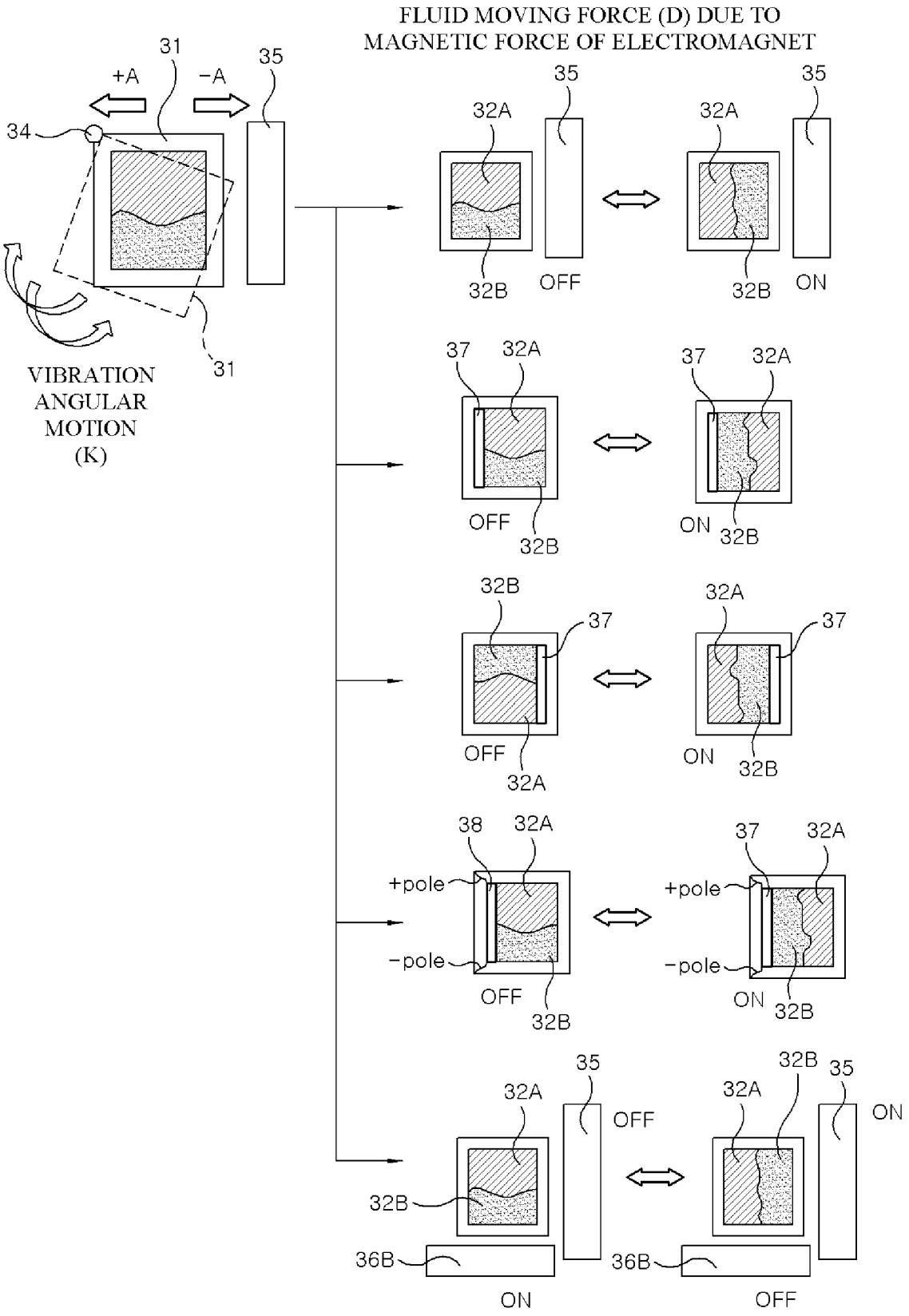
FIG. 5 illustrates an example of an operation state of the electromagnet-type flow change generation device according to various exemplary embodiments of the present invention.

Meanwhile, FIG. 4 and FIG. 5 illustrate operation states of the vibration-type flow change generation device 30-1 and the electromagnet-type flow change generation device 30-2, respectively. In the instant case, the hybrid-type flow change generation device 30-3 illustrated in FIG. 1 causes the synergy operations and effects by the operations and effects of the electromagnet-type flow change generation device 30-2 illustrated in FIG. 5 in addition to the operations and effects of the vibration-type flow change generation device 30-1 illustrated in FIG. 4 such that a detailed description thereof is substituted with the descriptions of FIG. 4 and FIG. 5.

First, referring to FIG. 4, the vibration-type flow change generation device 30-1 is exemplarily the method for applying the first and second fluids 32A, 32B having different materials and the method for applying the fluid 32 and the solid 33.

As an example, in the case where the vibration-type flow change generation device 30-1 is the method for applying the first and second fluids 32A, 32B having different materials, when the flowage of the inertia using the inertia force (i.e., +A inertia force or −A inertia force) due to the change in the vehicle speed is applied to the first and second fluids 32A, 32B, the first and second fluids 32A, 32B form a density difference fluid moving force B which mixes the first fluid 32A, which is the rarer material, with the second fluid 32B, which is the denser material, by the flowage of the inertia such that the movement of the vibration box 31 is formed while the flowage of the inertia is maintained.

As an example, in the case where the vibration-type flow change generation device 30-1 utilizes the method for applying the fluid 32 and the solid 33, when the flowage of the inertia using the inertia force (i.e., +A inertia force or −A inertia force) due to the change in the vehicle speed is applied to the fluid 32 and the solid 33, a density difference solid moving force C which moves the solid 33, which is the denser material, within the fluid 32, which is the rarer material, is formed by the flowage of the inertia such that the movement of the vibration box 31 is formed while the flowage of the inertia is maintained.

Accordingly, the vibration box 31 converts the movement by the density difference fluid moving force B or the density difference solid moving force C into the vibration angular motion K via the hinge shaft 34, and the shake by the vibration angular motion K of the vibration box 31 generates the air flow rate in the neighboring air around the light source which is the heat source of the optical module 10.

As described above, the vibration-type flow change generation device 30-1 generates the air flow rate in the air around the heat source in all of the methods for combining the first and second fluids 32A, 32B or the fluid 32 and the solid 33 to strengthen the air flow for the heat sink 20, largely enhancing the heat sink heat-dissipation efficiency.

Subsequently, referring to FIG. 5, the electromagnet-type flow change generation device 30-2 will be described by classifying the first and second fluids 32A, 32B and the electromagnet 35 as a first combination method, the first and second fluids 32A, 32B and the embedded electromagnet 37 as a second combination method, the first and second fluids 32A, 32B and the PCB electromagnet 38 as a third combination method, and the first and second fluids 32A, 32B and the dual electromagnet 36 as a fourth combination method.

Hereinafter, although it has been descried that the first fluid 32A is the non-polar material which is the rarer material, and the second fluid 32B is the polar material which is the denser material, as necessary, the first fluid 32A may be applied with the polar material which is the rarer material, and the second fluid 32B may be applied with the non-polar material which is the denser material. Furthermore, the current controller 40 repetitively performs the power source OFF (i.e., the shut-down of the power source) and the power source ON (i.e., the supply of the power) for the electromagnet based on the vehicle acceleration change value or the vehicle vibration detection value.

As an example, in the first combination method, the electromagnet 35 does not generate the magnetic force upon power source OFF on one side of the vibration box 31 and then generates the magnetic force upon power source ON such that the magnetic force pulls the second fluid 32B which is the polar material, and the flowage movement of the second fluid 32B changes the location of the first fluid 32A. Subsequently, when the electromagnet 35 releases the generation of the magnet force upon power source OFF, the second fluid 32B, which is the polar material, is released from the state pulled by the magnetic force to change the location of the first fluid 32A again.

As described above, the first combination method repeats "the release of the magnetic force↔the generation of the magnetic force" by repeating "power source OFF↔power source ON" of the electromagnet 35 outside the vibration box 31 such that the first fluid 32A and the second fluid 32B form a magnetic force fluid moving force D by the magnetic force, forming the movement of the vibration box 31 while the magnetic force is continuously generated.

Therefore, in the vibration box 31, the vibration angular motion K via the hinge shaft 34 is further strengthened by the movement due to the fluid moving force D by the magnetic force added to the density difference fluid moving force B of the flowage of the inertia, and the strengthening of the vibration angular motion K further strengthens the shake of the vibration box 31 such that the air flow rate for the neighboring air around the light source which is the heat source of the optical module 10 is generated more strongly.

As an example, the second combination method repeats "the release of the magnetic force↔the generation of the magnetic force" while the embedded electromagnet 37 is switched between the power source OFF and the power source ON at one side or the other side of the internal space of the vibration box 31. Furthermore, the third combination method repeats "the release of the magnetic force↔the generation of the magnetic force" while the PCB electromagnet 38 is switched between the power source OFF and the power source ON at one side of the internal space of the vibration box 31.

Therefore, each of the second combination method and the third combination method is the same in that the locations of the first fluid 32A and the second fluid 32B are moved to generate the magnetic force fluid moving force D due to the magnetic force except for a difference in that the second fluid 32B, which is the polar material, directly receives the operation of the pulling force due to the magnetic force on one side or the other side inside the vibration box 31 compared to the state of receiving the operation of the pulling force due to the magnetic force on one side outside the vibration box 31 of the first combination method.

As an example, in the fourth combination method, the first electromagnet 36A is located on one side of the vibration box 31 and the second electromagnet 36B is located on the lower side thereof such that one of the first electromagnet 36A and the second electromagnet 36B always forms the magnetic force.

That is, the first electromagnet 36A is maintained as the power source ON upon power source OFF of the second electromagnet 36B whereas the first electromagnet 36A is maintained as the power source OFF upon power source ON of the second electromagnet 36B, and this continuously maintains "the generation of the magnetic force" while being switched between the power source OFF of the first electromagnet 36A+the power source ON of the second electromagnet 36B and the power source ON of the first electromagnet 36A+the power source OFF of the second electromagnet 36B.

Therefore, the second fluid 32B is pulled downward together by the magnetic force due to the power source ON of the second electromagnet 36B while being pulled toward one side thereof by the magnetic force due to the power source ON of the first electromagnet 36A such that the magnetic force fluid moving force D due to the magnetic force may be alternately formed toward one side and the lower side thereof.

Therefore, the fourth combination method is the same in that the locations of the first fluid 32A and the second fluid 32B are moved to generate the fluid moving force D due to the magnetic force except for a difference in that the second fluid 32B, which is the polar material, simultaneously receives the operation of the pulling force due to the magnetic force on one side and the lower side thereof outside the vibration box 31 compared to the state of receiving the operation of the pulling force due to the magnetic force on one side outside the vibration box 31 of the first combination method to operate more strongly.

As described above, in each of the first to fourth combination methods, the vibration box 31 may strengthen the vibration angular motion K by the magnetic force fluid moving force D due to the magnetic force in the state where the vibration angular motion K is generated based on the density difference fluid moving force B due to the inertia force (i.e., +A inertia force or −A inertia force) of the vehicle described with reference to FIG. 4 to further strengthen the air flow for the heat sink 20, enhancing the heat sink heat-dissipation efficiency more largely.

As described above, the lamp device 1 applied to the vehicle 100 according to the exemplary embodiment of the present invention includes the flow change generation device 30, which accelerates the air flow in the space around the heat sink 20 dissipating the heat due to the radiation of the light of the light source of the optical module 10 to form the air flow enhancing the heat-dissipation efficiency of the heat sink 20, and generates the flowage of the fluid by the shake due to any one of the inertia force of the vehicle, the magnetic force, and a combination of the inertia force of the vehicle and the magnetic force, largely enhancing the heat-dissipation efficiency with the heat dissipation using the change in the air flow around the heat source together with the heat dissipation due to the heat sink 20, and utilizes the inertia due to the change in the traveling state of the vehicle and the vibration of the engine tremors or the magnetic force or a combination of the vibration and the magnetic force, implementing the heat dissipation of the heat source and the heat sink 20 only by the change in the air flow around the heat source without electronic equipment.

In addition, the term related to a control device such as "controller", "control unit", "control device" or "control module", etc refers to a hardware device including a memory and a processor configured to execute one or more steps interpreted as an algorithm structure. The memory stores algorithm steps, and the processor executes the algorithm steps to perform one or more processes of a method in accordance with various exemplary embodiments of the present invention. The controller according to exemplary embodiments of the present invention may be implemented through a nonvolatile memory configured to store algorithms for controlling operation of various components of a vehicle or data about software commands for executing the algorithms, and a processor configured to perform operation to be described above using the data stored in the memory. The memory and the processor may be individual chips. Alternatively, the memory and the processor may be integrated in a single chip. The processor may be implemented as one or more processors.

The control device may be at least one microprocessor operated by a predetermined program which may include a series of commands for carrying out the method disclosed in the aforementioned various exemplary embodiments of the present invention.

The aforementioned invention can also be embodied as computer readable codes on a computer readable recording medium. The computer readable recording medium is any data storage device that can store data which can be thereafter read by a computer system. Examples of the computer readable recording medium include hard disk drive (HDD), solid state disk (SSD), silicon disk drive (SDD), read-only memory (ROM), random-access memory (RAM), CD-ROMs, magnetic tapes, floppy discs, optical data storage devices, etc. and implementation as carrier waves (e.g., transmission over the Internet).

In an exemplary embodiment of the present invention, each operation described above may be performed by a controller, and the controller may be configured by multiple controllers, or an integrated single controller.

For convenience in explanation and accurate definition in the appended claims, the terms "upper", "lower", "inner", "outer", "up", "down", "upwards", "downwards", "front", "rear", "back", "inside", "outside", "inwardly", "outwardly", "interior", "exterior", "internal", "external", "forwards", and "backwards" are used to describe features of the exemplary embodiments with reference to the positions of such features as displayed in the figures. It will be further understood that the term "connect" or its derivatives refer both to direct and indirect connection.

Furthermore, the term of "fixedly connected" signifies that fixedly connected members always rotate at a same speed. Furthermore, the term of "selectively connectable" signifies "selectively connectable members rotate separately when the selectively connectable members are not engaged to each other, rotate at a same speed when the selectively connectable members are engaged to each other, and are stationary when at least one of the selectively connectable members is a stationary member and remaining selectively connectable members are engaged to the stationary member".

The foregoing descriptions of specific exemplary embodiments of the present invention have been presented for purposes of illustration and description. They are not intended to be exhaustive or to limit the present invention to the precise forms disclosed, and obviously many modifications and variations are possible in light of the above teachings. The exemplary embodiments were chosen and described to explain certain principles of the present invention and their practical application, to enable others skilled in the art to make and utilize various exemplary embodiments of the present invention, as well as various alternatives and modifications thereof. It is intended that the scope of the present invention be defined by the Claims appended hereto and their equivalents.

What is claimed is:

1. A lamp apparatus comprising:

an optical module having a light source of radiating light;

a heat sink for dissipating a heat caused by the light source, by an air flow; and a flow change generation device generating a flowage of a fluid by a flowage movement of the fluid due to an inertia force of a vehicle, and dispersing the heat into the air flow; and an electromagnet, wherein the flow change generation device causes the flowage movement by a magnetic force of the electromagnet by supplying a power from a power source to the electromagnet.

2. The lamp apparatus of claim 1, wherein the fluid includes a first fluid and a second fluid, wherein the flow change generation device includes a vibration box having the first fluid and the second fluid having different densities and filled in the vibration box, and wherein the first fluid and the second fluid form the flowage of the fluid in the vibration box due to the inertia force of the vehicle to cause a flowage movement of the fluid in the vibration box.

3. The lamp apparatus of claim 2, wherein the first fluid is made of a rarer material, and the second fluid is made of a denser material to form a density difference between the first fluid and the second fluid.

4. The lamp apparatus of claim 3, wherein the first fluid is one of air, benzene, and toluene, and the second fluid is mercury or water.

5. The lamp apparatus of claim 1, wherein the flow change generation device includes a vibration box having the fluid filled therein and having a solid accommodated in the vibration box, and wherein the fluid converts a movement of the solid in the vibration box due to the inertia force of the vehicle to the flowage of the fluid to cause a flowage movement of the fluid in the vibration box.

6. The lamp apparatus of claim 5, wherein the fluid is water and the solid is a metal.

7. The lamp apparatus of claim 1, wherein the fluid includes a first fluid and a second fluid, wherein the flow change generation device includes a vibration box having the first fluid and the second fluid having different densities and filled in the vibration box, and the electromagnet for generating the magnetic force, and wherein a first flowage of the fluid of the first fluid and the second fluid caused by the inertia force of the vehicle and a second flowage of the fluid due to the magnetic force of the electromagnet are applied to the vibration box in combination to cause the flowage movement.

8. The lamp apparatus of claim 7, wherein the first fluid includes a rarer material which is one of a polar material and a non-polar material, and the second fluid includes a denser material which is one of the polar material and the non-polar material.

9. The lamp apparatus of claim 7, wherein the electromagnet is disposed on a side location outside the vibration box.

10. The lamp apparatus of claim 7, wherein the electromagnet is in plural to include a first electromagnet and a second electromagnet, and wherein the first electromagnet is disposed on a side location outside the vibration box and a lower side location of the vibration box.

11. The lamp apparatus of claim 7, wherein the electromagnet is disposed on a first side location or a second side location inside the vibration box.

12. The lamp apparatus of claim 7, wherein the electromagnet is disposed on a side location inside the vibration box while applying the power source to the light source of the optical module.

13. The lamp apparatus of claim 7, wherein the electromagnet is connected to a current controller, and wherein the current controller is configured to supply a current to the electromagnet so that the magnetic force is generated or to block a supply of the current to the electromagnet so that the magnetic force is released.

14. The lamp apparatus of claim 1, further including the electromagnet, wherein the flow change generation device combines the inertia force of the vehicle caused by deceleration or acceleration of the vehicle and the magnetic force caused by a supply of the power to the electromagnet to generate the flowage movement.

15. The lamp apparatus of claim 14, wherein the fluid includes a first fluid and a second fluid, and wherein the flow change generation device includes:

a vibration box having the first fluid of a rarer material which is one of a polar material and a non-polar material and the second fluid of a denser material which is one of the polar material and the non-polar material filled in the vibration box; and the electromagnet provided on at least one of a side location outside the vibration box, a side location and a lower side location outside the vibration box, a first side location inside the vibration box, and a second side location inside the vibration box.

16. The lamp apparatus of claim 15, wherein the electromagnet is connected to a current controller, and wherein the current controller is configured to supply a current to the electromagnet so that the magnetic force is generated or to block a supply of the current to the electromagnet so that the magnetic force is released.

17. The lamp apparatus of claim 1, wherein an end portion of a vibration box of the flow change generation device is pivotally hinged to a member so that the vibration box is moved by the flowage of the fluid with respect to the end portion.

18. A vehicle comprising:

the lamp apparatus of claim 1, wherein the lamp apparatus has the flow change generation device which accelerates the air flow in a space around the heat sink dissipating the heat generated by radiation of a light from the light source of the optical module for enhancing heat-dissipation efficiency of the heat sink, and generates the flowage of the fluid by a the flowage movement of the fluid due to one of the inertia force of the vehicle, the magnetic force, and a combination of the inertial force of the vehicle and the magnetic force.

19. The vehicle of claim 18, further including the electromagnet, wherein the inertia force of the vehicle is generated by deceleration or acceleration of the vehicle, and wherein the magnetic force is generated by a supply of the power to the electromagnet.

* * * * *